United States Patent [19]

McAleer

[11] 4,008,991

[45] Feb. 22, 1977

[54] HEAT POWER PLANT

[76] Inventor: William J. McAleer, R.R. 2, Morocco, Ind. 47963

[22] Filed: Oct. 20, 1975

[21] Appl. No.: 623,664

[52] U.S. Cl. ..... 431/1; 431/160; 431/168

[51] Int. Cl.[2] ..... F23C 5/02

[58] Field of Search ..... 431/1, 168, 160; 60/39.78

[56] References Cited

UNITED STATES PATENTS

| | | | |
|---|---|---|---|
| 2,409,036 | 10/1946 | Goddard | 431/1 X |
| 2,943,673 | 7/1960 | Hickman | 431/1 |
| 3,024,835 | 3/1962 | Ryder | 431/1 X |
| 3,395,967 | 8/1968 | Karr | 431/1 |
| 3,792,958 | 2/1974 | Siegfried | 431/1 |

*Primary Examiner*—Edward G. Favors
*Attorney, Agent, or Firm*—Woodard, Weikart, Emhardt & Naughton

[57] ABSTRACT

A power plant for producing heat. A frame is rotatably mounted within a container with an inertia wheel mounted to and rotatable with the frame. A fuel storage tank mounted within the frame is connected between and to an external source of fuel and a plurality of fuel injectors mounted to the inertia wheel. Cooling means within the container cover the frame and at least a portion of the inertia wheel with a combustion chamber provided within the container above the cooling means. Igniting means mounted to the container projects into the combustion chamber and is operable to ignite fuel intermittently injected into the combustion chamber by the injectors mounted to the inertia wheel. Pumping means provided on the frame is operable to pump fuel from the storage tank to the injectors in a timed relationship to the position of the injectors relative to the cooling means and combustion chamber. Heat is withdrawn from the container resulting from the combustion of the fuel.

8 Claims, 2 Drawing Figures

HEAT POWER PLANT

BACKGROUND OF THE INVENTION

1. Field of the Invention

This invention is in the field of power plants.

2. Description of the Prior Art

The power plant disclosed herein uses a laser beam for the ignition of intermittent injection of liquid hydrogen. An earlier device which uses a laser beam in a power plant is disclosed in U.S. Pat. No. 3,495,406 issued to Donatelli. Two additional patents have been granted which disclose the use of laser beams in nuclear reaction. The first patent is the U.S. Pat. No. 3,378,446 issued to Whittlesey which described the use of lasers to trigger thermonuclear reactions whereas the second U.S. Pat. No. 3,489,645 issued to Daiber describes the use of lasers to create controlled nuclear fusion reactions. Two additional patents of interest are U.S. Pat. No. 3,473,879 issued to Berberich which describes the use of a laser beam to periodically ignite a fuel-oxygen mixture and U.S. Pat. No. 3,719,454 issued to Shang which describes a laser controlled chemical reactor.

Summary of the Invention

One embodiment of the present invention is a heat producing apparatus comprising a sealed container with a heat outlet, a source of fuel located externally of the container, cooling means within the container dividing the container into a cooled portion and an uncooled portion with the uncooled portion providing a combustion chamber, a frame rotatably mounted in the container and positioned in the cooled portion, an inertia wheel rotatably mounted and connected to the frame being rotatable therewith, the inertia wheel being at least partially positioned in the cooled portion, fuel injectors mounted to the inertia wheel and positioned on the inertia wheel to move to and from the chamber as the inertia wheel rotates, the fuel injectors being connected to the source of fuel and including pump means and ignition means mounted to the container and projecting into the chamber operable to ignite fuel injected into the chamber producing heat.

It is an object of the present invention to provide a new and improved heat power plant.

A further object of the present invention is to provide a hydrogen energy power plant for industrial use.

Yet another object of the present invention is to provide a power plant using liquid hydrogen fuel which is ignited by a laser beam.

Related objects and advantages of the present invention will be apparent from the following description.

DESCRIPTION OF THE PREFERRED EMBODIMENT

Figure 1:
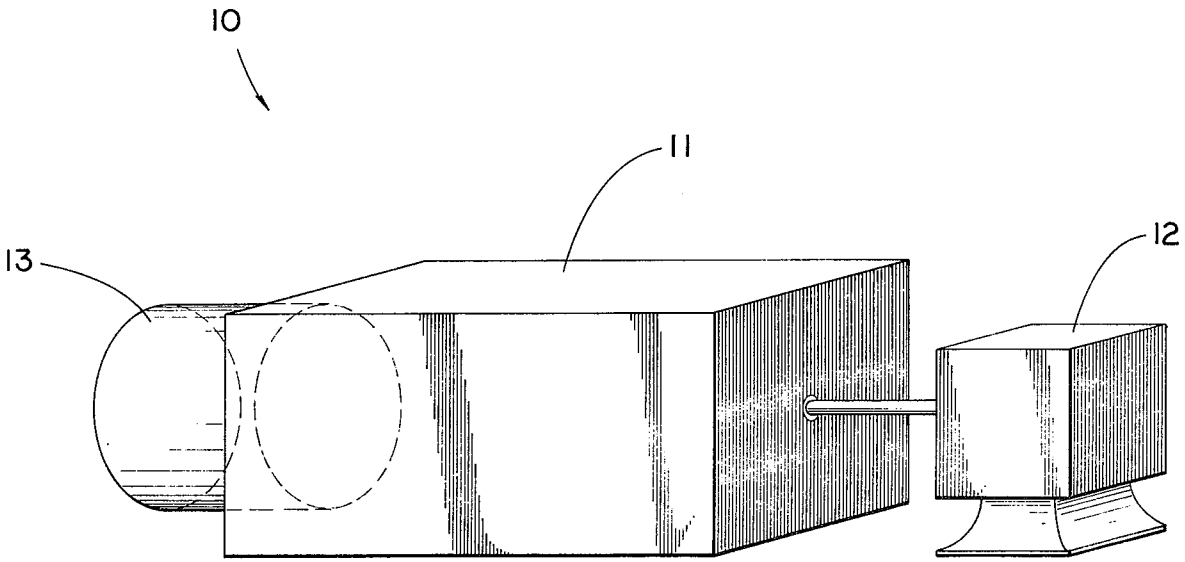
FIG. 1 is a perspective view of a power plant incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a heat producing apparatus 10 having a sealed container 11 with a source of fuel 12 located externally of the container and an inertia wheel 13 projecting outwardly from container 11.

Container 11 is sealed and includes a pair of heat outlets 14 and 15. A source of liquid hydrogen 12 is mounted externally of container 11 with a fuel outlet conduit 16 extending from source 12 sealingly through end wall 17 of container 11 to a valve 18 in turn connected to conduit 19 by rotary coupling 20.

A frame 21 is rotatably mounted by bearings 22 and 23 to walls 24 and 25 fixedly mounted to container 11. An electric motor 26 includes an output shaft 27 having a pulley wheel or sprocket 28 fixedly mounted thereto. A second pulley wheel or sprocket 29 is fixedly mounted to frame 21 with a drive belt or chain 30 engaged with wheels 28 and 29. Activation of motor 26 results in movement of the belt or drive chain 30 thereby rotating frame 21 in bearings 22 and 23. A relatively large inertia wheel 13 is fixedly mounted to frame 21 and extends sealingly through the end wall 31 of container 11. Appropriate seals 32 are provided to prevent leakage into or out of the container.

A fuel storage tank 34 is fixedly mounted by supports 35 and 36 to cross braces 37 fixedly attached to frame 21. Conduit 19 is connected to tank 34 and extends through frame 21 being connected to rotary coupling 20. Thus, by operation of valve 18, fuel flows from source 12 to storage tank 34. Rotary coupling 20 allows for a rotation of conduit 19 along with storage tank 34 and frame 21. A plurality of injectors 37, 38, 39 and 40 are mounted to the interior surface 41 of inertia wheel 13. Injectors 37 through 40 are connected respectively to pumps 42, 43, 44 and 45 mounted interiorly to frame 21. Fuel from storage tank 34 is routed to pumps 42 through 45 by conduits 46, 47, 48 and 49. Fuel is then pumped from pumps 42 through 45 via conduits 50, 51, 52 and 53 to respectively fuel injectors 37 through 40.

An electric motor 50 is mounted interiorly to the bottom wall of container 11 and is provided with an output shaft having a pulley wheel or sprocket 51 fixedly mounted thereto. Another pulley wheel or sprocket 52 is fixedly mounted to shaft 53 with a drive belt or chain 54 connecting pulley wheels 51 and 52. Activation of motor 50 results in rotation of pulley wheel 52 and rotation of shaft 53 bearingly received and supported by bearings 55 and 56 fixedly mounted to frame 21. Thus, activation of motor 50 results in the rotation of shaft 53 independent of the rotation of frame 21.

A pair of double-grooved pulley wheels 57 and 58 are fixedly mounted to rotatable shaft 53. Pulley wheels 57 and 58 are engaged with pulley wheels 59 through 62 fixedly mounted to the input drive shafts of pumps 42 through 45. For example, drive belt 63 is engaged with pulley wheels 59 and 57 whereas drive belt 64 is engaged with a separate groove of pulley wheel 57 and pulley wheel 61. Thus, rotation of shaft 53 by motor 50 results in the rotation of the input drive shaft of pumps 42 through 45. In lieu of pulley wheels and belts mounted to the input drive shafts, sprockets and drive chains may be utilized.

Each pump 42 through 46 is provided with a trip switch which extends through the vertical side wall 65 of frame 21. Wall 24 of container 11 is positioned to contact each pump trip switch as the frame rotates moving each trip switch past wall 24. For example, trip switches 66 and 67 of pumps 42 and 43 are shown in the extended position since the pumps are located away from wall 24 whereas trip switches 68 and 69 of pumps 44 and 45 are shown depressed since the pumps are positioned immediartely adjacent wall 24. The activation of the pumps by the trip switches provides a timing relationship for the injection of fuel from fuel injectors 37 through 40.

Cooling means is provided within the container dividing the container into a cooled portion 70 and an uncooled chamber 71. The cooling means may include a liquid 72 which partially fills the container covering frame 21 and at least a portion of wheel 13. Thus, with rotation of frame 21, the injectors will eventually move from the liquid 72 into the uncooled chamber 71. For example, injector 37 is shown positioned within chamber 71 whereas the remaining injectors are shown as being submerged in the cooling liquid.

Ignition means is provided for igniting the fuel injected into chamber 71 by the fuel injectors. In the embodiment shown in the drawings, the ignition means includes a laser beam device 75 mounted to the top wall of the container. Device 75 is operable to project a laser beam into chamber 71 whenever fuel is injected into the chamber by the fuel injectors. The laser beam ignites the fuel which expands in chamber 71 with chamber 71 providing a combustion chamber. The heat from the combustion may be withdrawn from the container by withdrawing the heated gas via exit 14 which is provided with a suitable on-off valve or by withdrawing liquid 72, which eventually will become heated, via outlet 15 also provided with an on-off valve. Of course, additional air may be injected into chamber 71 via a suitable inlet in the event heated gas is to be withdrawn via outlet 14. Likewise, additional liquid may be inserted into portion 70 via a suitable inlet in the event heated liquid is to be withdrawn via outlet 15.

Figure 2:
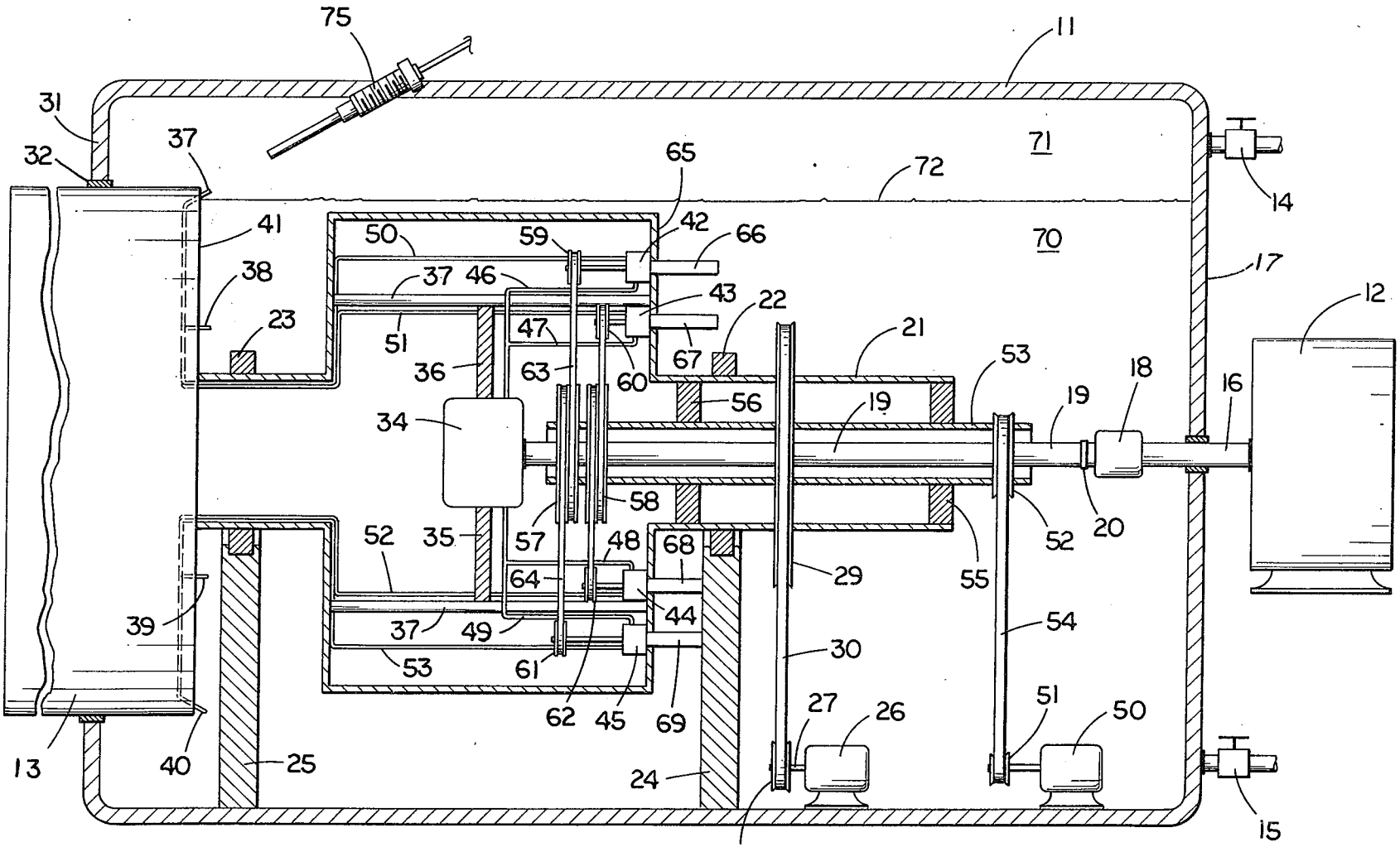
FIG. 2 is an enlarged fragmentary cross-sectional view of the power plant of FIG. 1.

In order to operate the power plant shown in FIG. 2, both motors 26 and 50 are activated thereby causing the simultaneous rotation of frame 21 and shaft 53. Rotation of frame 21 causes wheel 13 to rotate thereby positioning one injector at a time into the combustion chamber 71. In the event motor 26 is activated without activation of motor 50, then frame 21 will rotate; however, the pulley belts connected to pulley wheels 57 and 58 will merely "walk around" the pulley wheels 57 and 58 and will not cause rotation of the input drive shafts to the pumps. Activation of motor 50 results in the pumps forcing liquid hydrogen fuel from storage tank 34 to the injectors. In addition, wall 24 trips the trip switches of each pump thereby causing the fuel to be injected from the appropriate injector into the combustion chamber. A time lag is provided so that when the trip switch of a particular pump is depressed by wall 24, the fuel will not be injected from the injector connected to the particular pump until the injector reaches combustion chamber 71. Thus, the fuel is injected into the combustion chamber on an intermittent basis.

The laser beam igniter is used only at the very start to ignite the initial fuel injected into the combustion chamber. Subsequent injections of fuel will be automatically ignited by the combustion occurring within the chamber. Extremely high temperatures will occur in the combustion chamber thereby producing sufficient heat to either be withdrawn via the outlets shown in the drawing or the combustion chamber wall may be exposed to an external source of liquid such as water thereby vaporizing the water and producing superheated steam which in turn may be directed to turbine blades or used for heating. In lieu of frame 21 being submerged in a liquid, a cooling jacket may be placed over the frame thereby separating the frame from the combustion chamber. Liquid may then be circulated through the cooling jacket with liquid in the jacket absorbing heat which later may be extracted for use.

While although a variety of fuels may be utilized, it is anticipated that a hydrogen fuel such as deuterium will be utilized. It is anticipated that the injectors will inject 0.5 milligrams of deuterium into the combustion chamber as each injector enters into the combustion chamber.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A heat producing apparatus comprising:
a sealed container with a heat outlet;
a source of fuel located externally of said container;
cooling means within said container dividing said container into a cooled portion and an uncooled portion with said uncooled portion providing a combustion chamber;
a frame rotatably mounted in said container and positioned in said cooled portion;
an inertia wheel rotatably mounted and connected to said frame being rotatable therewith, said inertia wheel being at least partially positioned in the said cooled portion;
fuel injectors mounted to said inertia wheel and positioned on said inertia wheel to move to and from said chamber as said inertia wheel rotates, said fuel injectors being connected to said source of fuel and including pump means; and,
ignition means mounted to said container and projecting into said chamber operable to ignite fuel injected into said chamber producing heat.

2. The apparatus of claim 1 and further comprising:
drive means engaged with said frame being operable to rotate said frame along with said inertia wheel.

3. The apparatus of claim 2 and further comprising:
a fuel storage tank mounted to and rotatable with said frame, said fuel storage tank being connected to and receiving fuel from said source of fuel and further connected to said injectors.

4. The apparatus of claim 3 wherein:
said pump means includes a shaft rotatably mounted to said frame and further includes a plurality of pumps with rotatable inputs with said pumps mounted to said frame and rotatable therewith, said pump means includes a driver engaged with said shaft operable to rotate said shaft in turn engaged with said rotatable inputs of said pumps to operate said pumps.

5. The apparatus of claim 4 wherein:
said fuel storage tank includes a fuel input conduit connected to said source of fuel, said conduit includes a rotatable coupling allowing rotation of said conduit when said source of fuel is stationary, said conduit extends through said shaft and into said frame.

6. The apparatus of claim 5 wherein:

said pumps include trip switches engageable with said container to time pumping action of said pumps relative to the rotational position of said injectors on said inertia wheel.

7. The apparatus of claim 1 wherein:

said source of fuel includes hydrogen fuel.

8. The apparatus of claim 7 wherein:

said hydrogen fuel is deuterium.

* * * * *